US011619196B2

(12) United States Patent
Dudar

(10) Patent No.: US 11,619,196 B2
(45) Date of Patent: Apr. 4, 2023

(54) METHODS AND SYSTEMS FOR DIAGNOSING DEGRADATION OR ALTERATION IN AN EVAPORATIVE EMISSION CONTROL SYSTEM

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 17/443,934

(22) Filed: Jul. 28, 2021

(65) Prior Publication Data

US 2023/0034896 A1 Feb. 2, 2023

(51) Int. Cl.
*F02M 25/08* (2006.01)

(52) U.S. Cl.
CPC ..... *F02M 25/0818* (2013.01); *F02M 25/089* (2013.01); *F02M 25/0854* (2013.01)

(58) Field of Classification Search
CPC ..... F02M 25/0818; F02M 25/0854; F02M 25/089
See application file for complete search history.

(56) References Cited

U.S. PATENT DOCUMENTS

| | | | | |
|---|---|---|---|---|
| 10,100,771 | B2 | 10/2018 | Dudar | |
| 10,151,265 | B2 | 12/2018 | Dudar | |
| 10,167,823 | B2 | 1/2019 | Dudar | |
| 10,451,010 | B2 | 10/2019 | Dudar | |
| 2016/0215714 | A1* | 7/2016 | Yang | G01F 22/02 |
| 2017/0045007 | A1* | 2/2017 | Pursifull | B60K 15/03504 |
| 2017/0058800 | A1 | 3/2017 | Dudar | |
| 2019/0293031 | A1* | 9/2019 | Dudar | F01N 3/2006 |
| 2020/0369508 | A1 | 11/2020 | Dudar | |

* cited by examiner

*Primary Examiner* — Xiao En Mo
(74) *Attorney, Agent, or Firm* — Vincent Mastrogiacomo; McCoy Russell LLP

(57) ABSTRACT

Methods and systems are provided for diagnosing degradation and/or alteration in an evaporative emission control system of a vehicle. In one example, a method for a vehicle may comprise, during a refueling event, detecting presence or absence of a fuel vapor canister coupled to a vent line of the evaporative emission control system of the vehicle based on a response of a hydrocarbon sensor coupled to the vent line. In this way, hydrocarbon emissions may be reduced by identifying vehicles with tampered or degraded evaporative emission control system.

19 Claims, 7 Drawing Sheets

METHODS AND SYSTEMS FOR DIAGNOSING DEGRADATION OR ALTERATION IN AN EVAPORATIVE EMISSION CONTROL SYSTEM

FIELD

The present description relates generally to methods and systems for diagnosing degradation and/or alteration in an evaporative emission control system of a vehicle, and particularly for detecting a missing or degraded fuel vapor canister included therein.

BACKGROUND/SUMMARY

Vehicles, such as plug-in hybrid electric vehicles (PHEVs), may include a fuel system connected to an evaporative emission control (EVAP) system, wherein a fuel tank of the fuel system may be fluidically coupled to a fuel vapor canister of the EVAP system for filtering, and venting fuel vapors from the fuel tank. In order to reduce emissions and comply with regulations, fuel vapors from the fuel tank are stored in the fuel vapor canister of the EVAP system. Over time and use, the fuel vapor canister may be degraded or damaged and may need to be replaced. However, replacing such canisters may be considerably expensive. In absence of an operational fuel vapor canister, fuel vapors may no longer be stored in the EVAP system and may be released to the atmosphere, thereby increasing undesired emissions.

One approach to detecting undesired hydrocarbon emissions from a vehicle is to install a hydrocarbon sensor at a canister vent port of the EVAP system, which can detect if fuel vapors are escaping to atmosphere as shown in U.S. Pat. Nos. 10,451,010 and 10,151,265. However, the inventors herein have recognized potential issues with the above approach. As one example, the approach may not be able to detect a missing fuel vapor canister from the EVAP system and further alterations of the EVAP system. In certain situations, in order to save service costs, instead of replacing a degraded canister, it is known to tamper or alter the EVAP system in a way such that the fuel vapor canister is completely removed from the system and replaced with a straight tube (connecting fuel vapor line directly to atmosphere) without causing any detectable leaks. However, elimination of a fuel vapor canister and tampering of the EVAP system may cause undesired increase in emissions.

In one example, the issues described above may be addressed by a method for a vehicle comprising, during a refueling event, detecting presence or absence of a fuel vapor canister coupled to a vent line of the evaporative emission control system of the vehicle based on a response of a hydrocarbon sensor coupled to the vent line. For example, when present the fuel vapor canister can be confirmed as present, and when absent, the canister can be confirmed as absent. In this way, by detecting the presence and/or absence of the fuel vapor canister, even when a leak is not detectable by other diagnostic methods, it is possible to improve robustness of the EVAP system diagnostics.

As one example, a hydrocarbon sensor may be coupled to a vent line of the EVAP system downstream of the canister. During a refueling event, a time lag between an increase in fuel level (FLI) and an output of the HC sensor may be monitored. If the time lag between fuel level increase and HC sensor response is lower than a first threshold time, it may be inferred that the fuel vapor canister is missing from the EVAP system. The method may additionally detect that the EVAP system has been altered, wherein the canister may be replaced by a straight tube connecting the fuel vapor line to the atmosphere. Alternatively, if the time lag between fuel level increase and HC sensor response is higher than the first threshold time but lower than a second threshold time, it may be inferred that the canister is present but likely degraded.

In this way, a degradation and/or alteration in an evaporative emission control system of a vehicle may be diagnosed. The systems and the diagnostic methods, according to the present disclosure, assist in identifying vehicles with tampered or degraded evaporative emission control system rapidly and efficiently. The methods in accordance with the present disclosure are not only useful for monitoring vehicle emissions for vehicle certification but by undertaking suitable mitigating actions, undesired hydrocarbon emissions may be reduced and compliance with regulations may be improved. Furthermore, overall manufacturing costs are reduced as installation of additional or specialized components may be minimized.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
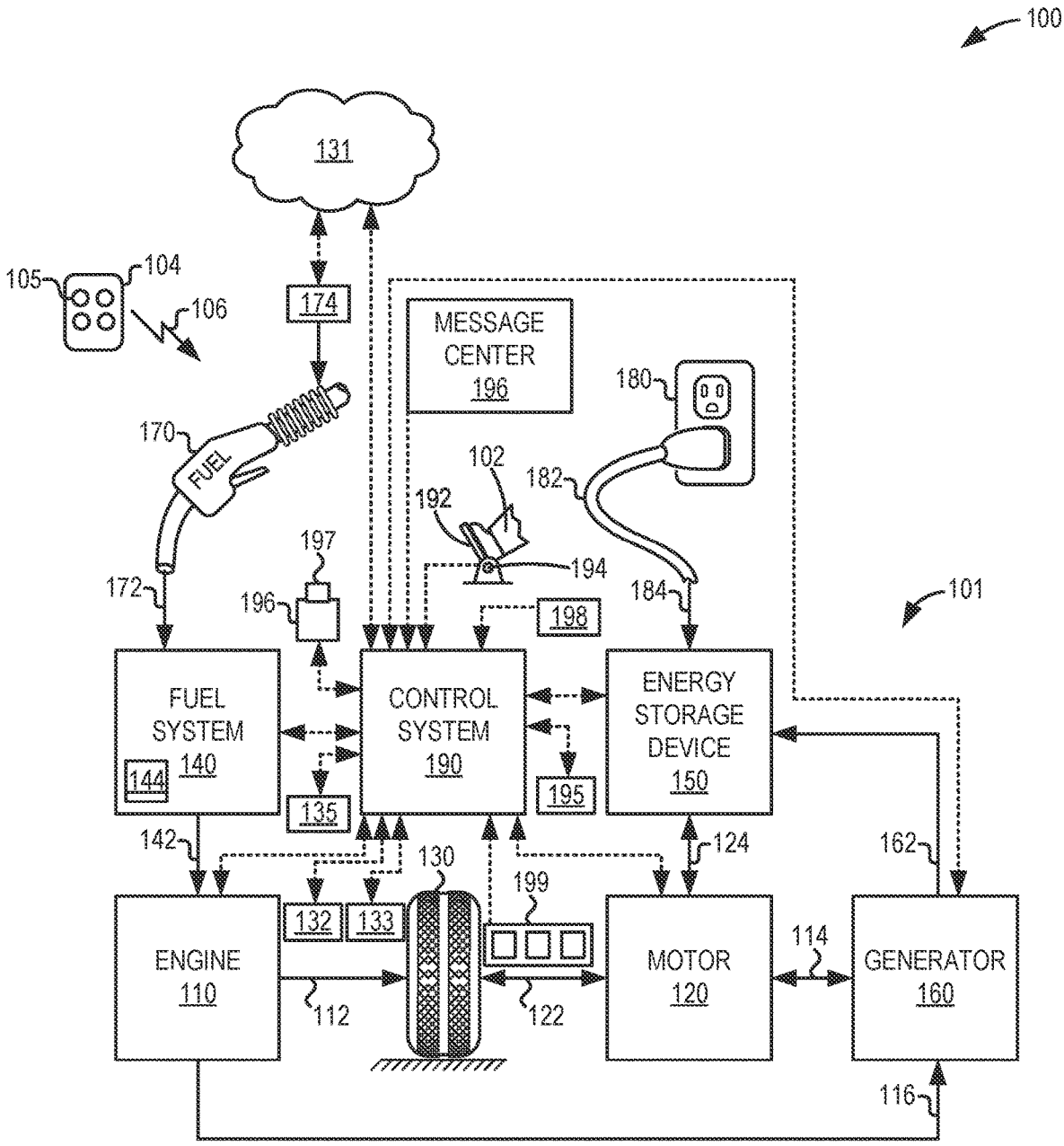
FIG. 1 shows a high-level block diagram illustrating an example vehicle system.
Figure 2:
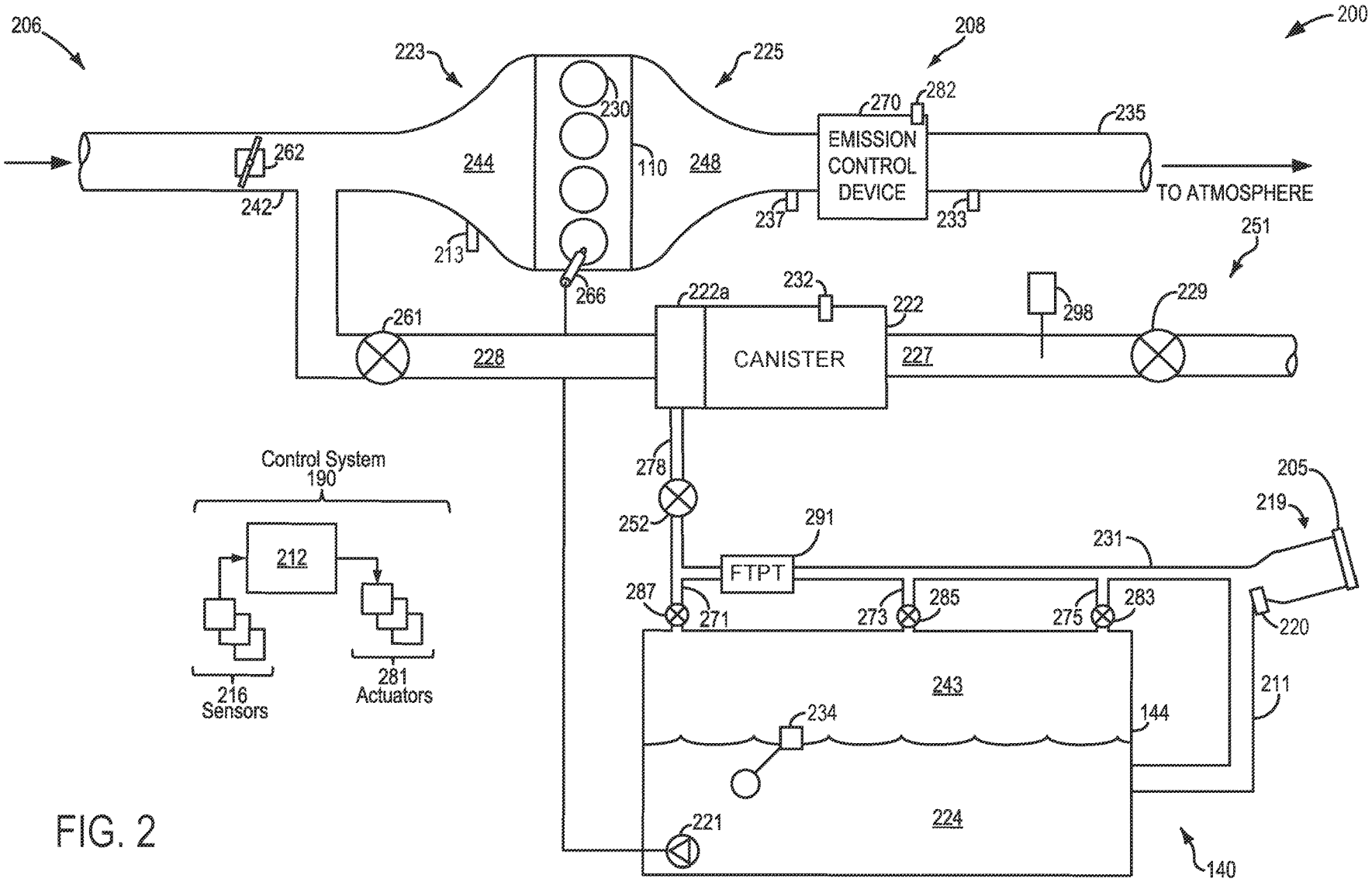
FIG. 2 shows a schematic diagram of a portion of the example vehicle system of FIG. 1, the portion of the example vehicle system including a fuel system and an evaporative emission control system.
Figure 3A:
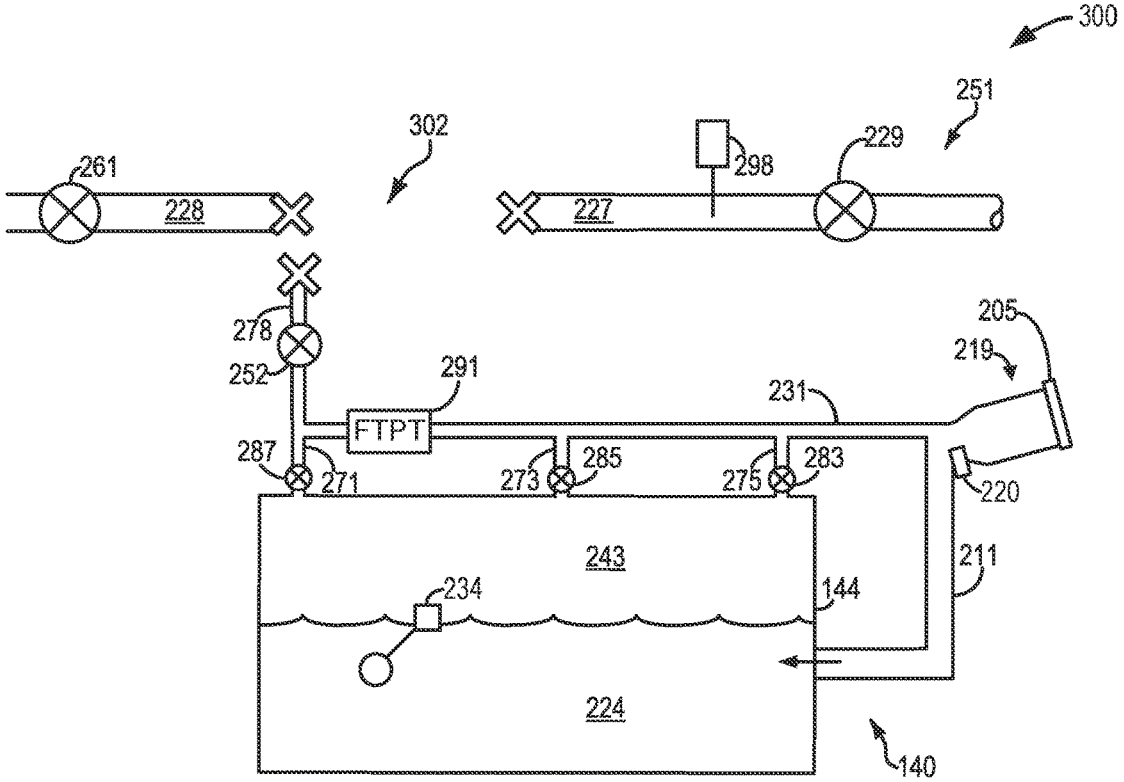
FIG. 3A shows a schematic diagram of the evaporative emission control system of FIG. 2 indicating tampering or alteration that causes a large detectable leak.
Figure 3B:
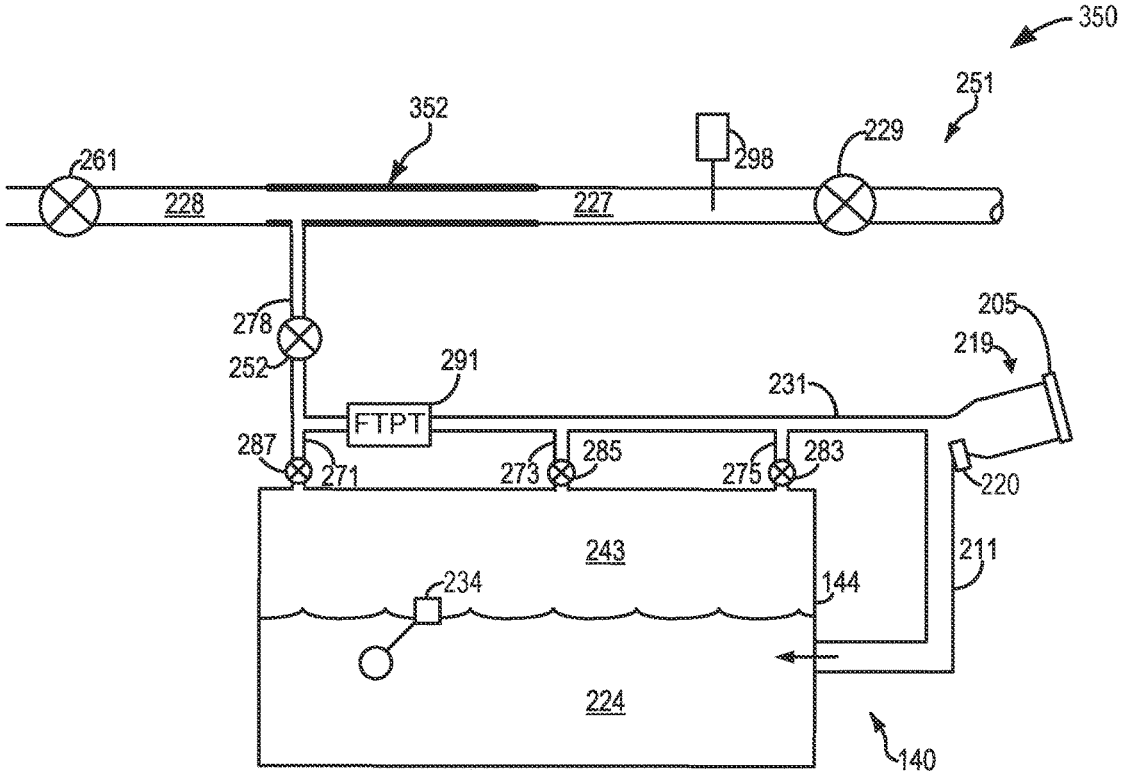
FIG. 3B shows a schematic diagram of the evaporative emission control system of FIG. 2 indicating tampering or alteration that causes an undetectable leak.

The following description relates to methods and systems for diagnosing degradation and/or alteration in an evaporative emission control system of a vehicle, such as the vehicle system of FIG. 1. The vehicle system of FIG. 1 may include a fuel system and an evaporative emission control system fluidically coupled to each other, as shown in FIG. 2. A degradation in the evaporative emission control system may include either a degraded or a missing fuel vapor canister in accordance with the present disclosure. An alteration of the evaporative emission control system may include replacement of the fuel vapor canister with a straight tube connecting fuel vapor line to the atmosphere, according to the present disclosure. FIG. 3A provides a schematic diagram of the evaporative emission control system with a missing fuel vapor canister, while FIG. 3B provides a schematic diagram of an altered evaporative emission control system after removal of the fuel vapor canister. A control routine may be implemented by a controller included in the vehicle system, the controller configured to notify a vehicle operator of a missing or degraded fuel vapor canister and/or an altered evaporative emission control system and adjust one or more engine operating parameters to mitigate deleterious effects of the altered or degraded evaporative emission control system. As one example, the control routine may include methods depicted in FIGS. 4 and 5 for diagnosing an alteration and/or degradation in the fuel vapor canister of the evaporative emission control system. The diagnosis may be performed by monitoring a hydrocarbon sensor located in the evaporative emission control system. Further, FIG. 6 provides a graphical display of an exemplary vehicle operating sequence to illustrate the systems and methods in greater detail. In this way, vehicles may be maintained in full compliance with emission regulations and degradations or alterations in the evaporative emission control system may be identified rapidly and efficiently.

Referring now to FIG. 1, a high-level block diagram 100 depicting an example vehicle propulsion system 101 is shown. Vehicle propulsion system 101 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. In such an example, a vehicle with vehicle propulsion system 101 may be referred to as a hybrid electric vehicle (HEV).

Vehicle propulsion system 101 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via one or more drive wheels 130 (as indicated by an arrow 122) while engine 110 is deactivated.

During other operating conditions, engine 110 may be set to a deactivated state (as described above) while motor 120 may be operated to charge an energy storage device 150. For example, motor 120 may receive wheel torque from drive wheel(s) 130 (as indicated by arrow 122), where the motor may convert the kinetic energy of the vehicle to electrical energy for storage at an energy storage device 150 (as indicated by an arrow 124). This operation may be referred to as regenerative braking of the vehicle. Thus, motor 120 can provide a generator function in some examples. However, in other examples, a generator 160 may instead receive wheel torque from drive wheel(s) 130, where the generator may convert the kinetic energy of the vehicle to electrical energy for storage at energy storage device 150 (as indicated by an arrow 162).

During still other operating conditions, engine 110 may be operated by combusting fuel received from a fuel system 140 (as indicated by an arrow 142). For example, engine 110 may be operated to propel the vehicle via drive wheel(s) 130 (as indicated by an arrow 112) while motor 120 is deactivated. During other operating conditions, both engine 110 and motor 120 may each be operated to propel the vehicle via drive wheel(s) 130 (as indicated by arrows 112 and 122, respectively). A configuration where both engine 110 and motor 120 may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 101 may be configured as a series type vehicle propulsion system, whereby engine 110 does not directly propel drive wheel(s) 130. Rather, engine 110 may be operated to power motor 120, which may in turn propel the vehicle via drive wheel(s) 130 (as indicated by arrow 122). For example, during select operating conditions, engine 110 may drive generator 160 (as indicated by an arrow 116), which may in turn supply electrical energy to one or more of motor 120 (as indicated by an arrow 114) and energy storage device 150 (as indicated by arrow 162). As another example, engine 110 may be operated to drive motor 120 which may in turn provide a generator function to convert engine output to electrical energy, where the electrical energy may be stored at energy storage device 150 for later use by motor 120.

Fuel system 140 may include one or more fuel tanks 144 for storing fuel onboard the vehicle. For example, fuel tank 144 may store one or more liquid fuels, including but not limited to gasoline, diesel, and alcohol fuels. In some examples, the fuel may be stored onboard the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 (as indicated by arrow 142). Still other suitable fuels or fuel blends may be supplied to engine 110, where they may be combusted at engine 110 to produce the engine output. The engine output may be utilized to propel the vehicle (e.g., via drive wheel(s) 130, as indicated by arrow 112) or to recharge energy storage device 150 via motor 120 or generator 160.

In some examples, energy storage device 150 may be configured to store electrical energy that may be supplied to other electrical loads residing onboard the vehicle (other than motor 120), including cabin heating and air conditioning, engine starting, headlights, cabin audio and video systems, etc. As a non-limiting example, energy storage device 150 may include one or more batteries and/or capacitors.

A control system 190 may communicate at least with one or more of engine 110, motor 120, fuel system 140, energy storage device 150, and generator 160. Specifically, control system 190 may receive sensory feedback information at least from one or more of engine 110, motor 120, fuel system 140, energy storage device 150, and generator 160. Further, control system 190 may send control signals at least to one or more of engine 110, motor 120, fuel system 140, energy storage device 150, and generator 160 responsive to the sensory feedback information. Control system 190 may receive an indication of an operator requested output of vehicle propulsion system 101 from a vehicle operator 102. For example, control system 190 may receive sensory feedback from a pedal position sensor 194 which communicates with a pedal 192. Pedal 192 may refer schematically to a brake pedal and/or an accelerator pedal. Furthermore, in some examples, control system 190 may be in communication with a remote engine start receiver 195 (or transceiver)

that receives wireless signals 106 from a key fob 104 having a remote start button 105. In other examples (not shown), a remote engine start may be initiated via a cellular telephone or smartphone based system where a cellular telephone or smartphone (e.g., operated by vehicle operator 102) may send data to a server and the server may communicate with the vehicle (e.g., via a wireless network 131) to start engine 110.

Energy storage device 150 may periodically receive electrical energy from a power source 180 residing external to the vehicle, e.g., not part of the vehicle (as indicated by an arrow 184). As a non-limiting example, vehicle propulsion system 101 may be configured as a plug-in HEV (PHEV), whereby electrical energy may be supplied to energy storage device 150 from power source 180 via an electrical energy transmission cable 182. During a recharging operation of energy storage device 150 from power source 180, electrical energy transmission cable 182 may electrically couple energy storage device 150 to power source 180. When vehicle propulsion system 101 is subsequently operated to propel the vehicle, electrical energy transmission cable 182 may be disconnected between power source 180 and energy storage device 150. Control system 190 may identify and/or control an amount of electrical energy stored at energy storage device 150, which may be referred to as a state of charge (SOC).

In other examples, electrical energy transmission cable 182 may be omitted, and electrical energy may instead be received wirelessly at energy storage device 150 from power source 180. For example, energy storage device 150 may receive electrical energy from power source 180 via one or more of electromagnetic induction, radio waves, and electromagnetic resonance. More broadly, any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle (e.g., during a refueling event). As a non-limiting example, vehicle propulsion system 101 may be refueled by receiving fuel via a fuel dispensing device 170 (as indicated by an arrow 172), the fuel dispensing device being supplied with fuel by an external fuel pump 174. In some examples, fuel tank 144 may be configured to store the fuel received from fuel dispensing device 170 until the fuel is supplied to engine 110 for combustion. In some examples, control system 190 may receive an indication of a level of the fuel stored at fuel tank 144 (also referred to herein as the fuel level or fill level of fuel tank 144) via a fuel level sensor. The level of fuel stored at fuel tank 144 (e.g., as identified by the fuel level sensor) may be communicated to vehicle operator 102, for example, via a fuel gauge or indication in a vehicle instrument panel 196. In additional or alternative examples, control system 190 may be coupled to external fuel pump 174 via wireless network 131 (e.g., in a "smart" fuel pump configuration). In such examples, control system 190 may receive (e.g., via wireless network 131) signals indicative of an amount of fuel dispensed, a rate of fueling (e.g., during the refueling event), a distance of the vehicle from external fuel pump 174, an amount of money or credit available to vehicle operator 102 with which to purchase fuel at external fuel pump 174, etc. Accordingly, an expected level of fuel (e.g., a level of fuel expected assuming undegraded fuel system components) may be determined by control system 190 based on the signal received from external fuel pump 174. In some examples, the vehicle instrument panel 196 may include a refueling button which may be manually actuated or pressed by a vehicle operator to initiate refueling. For example, in response to the vehicle operator actuating the refueling button, fuel tank 144 in the vehicle may be depressurized so that refueling may be performed.

Vehicle propulsion system 101 may also include an ambient temperature/humidity sensor 198, and a roll stability control sensor, such as a lateral and/or longitudinal and/or yaw rate sensor(s) 199. As shown, sensors 198, 199 may be communicably coupled to control system 190, such that the control system may receive signals from the respective sensors. Vehicle instrument panel 196 may include indicator light(s) and/or a text-based display in which messages are displayed to vehicle operator 102 (e.g., such as an indication of a degradation status of a vehicle component generated by a diagnostic control routine). Vehicle instrument panel 196 may also include various input portions 197 for receiving an operator input, such as depressible buttons, touch screens, voice input/recognition, etc.

In some examples, vehicle propulsion system 101 may include one or more onboard cameras 135. Onboard camera (s) 135 may communicate photo and/or video imaging data to control system 190, for example. Onboard camera(s) 135 may in some examples be utilized to record images within a predetermined radius of the vehicle, for example. As such, control system 190 may employ signals (e.g., imaging data) received by onboard camera(s) 135 to detect and identify objects and locations external to the vehicle.

In additional or alternative examples, vehicle instrument panel 196 may communicate audio messages to vehicle operator 102 in combination with, or entirely without, visual display. Further, sensor(s) 199 may include a vertical accelerometer to indicate road roughness, the vertical accelerometer being communicably coupled to control system 190, for example. As such, control system 190 may adjust engine output and/or wheel brakes to increase vehicle stability in response to signals received from sensor(s) 199.

Control system 190 may be communicably coupled to other vehicles or infrastructures using appropriate communications technology. For example, control system 190 may be coupled to other vehicles or infrastructures via wireless network 131, which may comprise Wi-Fi, Bluetooth®, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles may either be direct between vehicles, or multi-hop. In some examples, longer range communications (e.g., WiMax) may be used in place of, or in conjunction with, V2V or V2I2V to extend coverage area on an order of a few miles. In still other examples, control system 190 may be communicably coupled to other vehicles or infrastructures via wireless network 131 and the Internet (e.g., cloud). In further examples, wireless network 131 may be a plurality of wireless networks 131 across which data may be communicated to vehicle propulsion system 101.

Vehicle propulsion system 101 may also include an onboard navigation system 132 (for example, a global positioning system, or GPS) with which vehicle operator 102 may interact. Onboard navigation system 132 may include one or more location sensors for assisting in estimating vehicle speed, vehicle altitude, vehicle position/location, etc. Such information may be used to infer engine operating parameters, such as local barometric pressure. As discussed above, control system 190 may be configured to receive information via the Internet or other communication networks. Accordingly, information received at control system 190 from onboard navigation system 132 may be cross-referenced to information available via the Internet to determine local weather conditions, local vehicle regulations, etc. In some examples, vehicle propulsion system 101 may include laser sensors (e.g., lidar sensors), radar sensors, sonar sensors, and/or acoustic sensors 133, which may enable vehicle location information, traffic information, etc., to be collected via the vehicle.

Referring to FIG. 2, a schematic diagram 200 depicting a vehicle system 206 is shown. In some examples, vehicle system 206 may be an HEV system, such as a PHEV system. For example, vehicle system 206 may be the same as vehicle propulsion system 101 of FIG. 1. However, in other examples, vehicle system 206 may be implemented in a non-hybrid vehicle (e.g., a vehicle equipped with an engine and without a motor operable to at least partially propel the vehicle).

Vehicle system 206 may include an engine system 208 coupled to each of an evaporative emissions control system 251 and fuel system 140. Engine system 208 may include engine 110 having a plurality of cylinders 230. Engine 110 may include an engine air intake system 223 and an engine exhaust system 225. Engine air intake system 223 may include a throttle 262 in fluidic communication with an engine intake manifold 244 via an intake passage 242. Further, engine air intake system 223 may include an air box and filter (not shown) positioned upstream of throttle 262. Engine exhaust system 225 may include an exhaust manifold 248 leading to an exhaust passage 235 that routes exhaust gas to the atmosphere. Engine exhaust system 225 may include an emission control device 270, which in one example may be mounted in a close-coupled position in exhaust passage 235 (e.g., closer to engine 110 than an outlet of exhaust passage 235) and may include one or more exhaust catalysts. For instance, emission control device 270 may include one or more of a three-way catalyst, a lean nitrogen oxide ($NO_x$) trap, a diesel particulate filter, an oxidation catalyst, etc. In some examples, an electric heater 282 may be coupled to emission control device 270, and utilized to heat emission control device 270 to or beyond a predetermined temperature (e.g., a light-off temperature of emission control device 270).

It will be appreciated that other components may be included in engine system 208 such as a variety of valves and sensors. For example, a barometric pressure sensor 213 may be included in engine air intake system 223. In one example, barometric pressure sensor 213 may be a manifold air pressure (MAP) sensor and may be coupled to engine intake manifold 244 downstream of throttle 262. Barometric pressure sensor 213 may rely on part throttle or full or wide open throttle conditions, e.g., when an opening amount of throttle 262 is greater than a threshold, in order to accurately determine a barometric pressure.

Fuel system 140 may include fuel tank 144 coupled to a fuel pump system 221. Fuel pump system 221 may include one or more pumps for pressurizing fuel delivered to cylinders 230 via fuel injectors 266 during a single cycle of cylinders 230 (while only a single fuel injector 266 is shown at FIG. 2, additional fuel injectors may be provided for each cylinder 230). A distribution or relative amounts of fuel delivered, injection timing, etc. may vary with operating conditions such as engine load, engine knock, exhaust temperature, etc. responsive to different operating or degradation states of fuel system 140, engine 110, etc.

Fuel system 140 may be a return-less fuel system, a return fuel system, or any one of various other types of fuel system. Fuel tank 144 may hold a fuel 224 including a plurality of fuel blends, e.g., fuel with a range of alcohol concentrations, such as gasoline, various gasoline-ethanol blends (including E10, E85), etc. A fuel level sensor 234 disposed in fuel tank 144 may provide an indication of the fuel level ("Fuel Level Input") to a controller 212 included in control system 190. As depicted, fuel level sensor 234 may include a float coupled to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be present in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211. In some examples, fuel filler pipe 211 may include a flow meter sensor 220 operable to monitor a flow of fuel being supplied to fuel tank 144 via the fuel filler pipe (e.g., during refueling).

During refueling, fuel cap 205 may be manually opened or may be automatically opened responsive to a refueling request received at controller 212. A fuel dispensing device (e.g., 170) may be received by, and thereafter fluidically coupled to, refueling system 219, whereby fuel may be supplied to fuel tank 144 via fuel filler pipe 211. Refueling may continue until the fuel dispensing device is manually shut off or until fuel tank 144 is filled to a threshold fuel level (e.g., until feedback from fuel level sensor 234 indicates the threshold fuel level has been reached), at which point a mechanical or otherwise automated stop of the fuel dispensing device may be triggered.

Evaporative emissions control system 251 may include one or more fuel vapor containers or canisters 222 for capturing and storing fuel vapors. Fuel vapor canister 222 may be coupled to fuel tank 144 via at least one conduit 278 including at least one fuel tank isolation valve (FTIV) 252 for isolating the fuel tank during certain conditions. For example, during engine operation, FTIV 252 may be kept closed to limit the amount of diurnal or "running loss" vapors directed to canister 222 from fuel tank 144. During refueling operations and selected purging conditions, FTIV 252 may be temporarily opened, e.g., for a duration, to direct fuel vapors from the fuel tank 144 to canister 222. Further, FTIV 252 may also be temporarily opened when the fuel tank pressure is higher than a threshold (e.g., above a mechanical pressure limit of the fuel tank), such that fuel vapors may be released into the canister 222 and the fuel tank pressure is maintained below the threshold.

Evaporative emissions control system 251 may include one or more emissions control devices, such as fuel vapor canister 222 filled with an appropriate adsorbent, the fuel vapor canister being configured to temporarily trap fuel vapors (including vaporized hydrocarbons) during refueling operations. In one example, the adsorbent used may be activated charcoal. Evaporative emissions control system 251 may further include a canister ventilation path or vent line 227 which may route gases out of fuel vapor canister 222 to the atmosphere when storing, or trapping, fuel vapors from fuel system 140.

Fuel vapor canister 222 may include a buffer 222*a* (or buffer region), each of the fuel vapor canister and the buffer including the adsorbent. As shown, a volume of buffer 222*a* may be smaller than (e.g., a fraction of) a volume of fuel vapor canister 222. The adsorbent in buffer 222*a* may be the same as, or different from, the adsorbent in fuel vapor canister 222 (e.g., both may include charcoal). Buffer 222*a* may be positioned within fuel vapor canister 222 such that, during canister loading, fuel tank vapors may first be adsorbed within the buffer, and then when the buffer is saturated, further fuel tank vapors may be adsorbed in a remaining volume of the fuel vapor canister. In comparison, during purging of fuel vapor canister 222, fuel vapors may first be desorbed from the fuel vapor canister (e.g., to a threshold amount) before being desorbed from buffer 222*a*. In other words, loading and unloading of buffer 222*a* may not be linear with loading and unloading of fuel vapor canister 222. As such, one effect of buffer 222*a* is to dampen any fuel vapor spikes flowing from fuel tank 144 to fuel vapor canister 222, thereby reducing a possibility of any fuel vapor spikes going to engine 110.

In some examples, one or more temperature sensors 232 may be coupled to and/or within fuel vapor canister 222. As fuel vapor is adsorbed by the adsorbent in fuel vapor canister 222, heat may be generated (heat of adsorption). Likewise, as fuel vapor is desorbed by the adsorbent in fuel vapor canister 222, heat may be consumed. In this way, the adsorption and desorption of fuel vapor by fuel vapor canister 222 may be monitored and estimated based on temperature changes within the fuel vapor canister.

Vent line 227 may also allow fresh air to be drawn into fuel vapor canister 222 when purging stored fuel vapors from fuel system 140 to engine air intake system 223 via purge line 228 and purge valve 261. For example, purge valve 261 may normally be closed but may be opened during certain conditions so that vacuum from engine intake manifold 244 may be provided to fuel vapor canister 222 for purging. In some examples, vent line 227 may further include an air filter 259 disposed therein downstream of fuel vapor canister 222.

Flow of air and vapors between fuel vapor canister 222 and the atmosphere may be regulated by a canister vent valve 229. Canister vent valve 229 may be a normally open valve, so that FTIV 252 may control venting of fuel tank 144 with the atmosphere. As described above, FTIV 252 may be positioned between fuel tank 144 and fuel vapor canister 222 within conduit 278. FTIV 252 may be a normally closed valve, that when opened, allows for venting of fuel vapors from fuel tank 144 to fuel vapor canister 222. Fuel vapors may then be vented to atmosphere via canister vent valve 229, or purged to engine air intake system 223 via canister purge valve 261.

In some examples, evaporative emissions control system 251 may further include an evaporative level check monitor (ELCM). ELCM may be disposed in vent line 227 and may be configured to control venting and/or assist in detection of undesired evaporative emissions. As an example, ELCM may include a vacuum pump for applying negative pressure to the fuel system when administering a test for undesired evaporative emissions. In some embodiments, the vacuum pump may be configured to be reversible. In other words, the vacuum pump may be configured to apply either a negative pressure or a positive pressure on the evaporative emissions control system 251 and fuel system 140. ELCM may further include a reference orifice, a pressure sensor, and a change-over valve (COV). A reference check may thus be performed whereby a vacuum may be drawn across the reference orifice, where the resulting vacuum level comprises a vacuum level indicative of an absence of undesired evaporative emissions. For example, following the reference check, the fuel system 140 and evaporative emissions control system 251 may be evacuated by the ELCM vacuum pump. In the absence of undesired evaporative emissions, the vacuum may pull down to the reference check vacuum level. Alternatively, in the presence of undesired evaporative emissions, the vacuum may not pull down to the reference check vacuum level.

A hydrocarbon (HC) sensor 298 may be present in evaporative emissions control system 251 to indicate the concentration of hydrocarbons in vent line 227. As illustrated, hydrocarbon sensor 298 is positioned between fuel vapor canister 222 and canister vent valve 229. A probe (e.g., sensing element) of hydrocarbon sensor 298 is exposed to and senses the hydrocarbon concentration of fluid flow in vent line 227. Hydrocarbon sensor 298 may be used by the control system 190 for determining breakthrough of hydrocarbon vapors from fuel vapor canister 222, in one example.

Fuel system 140 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open fuel tank isolation valve (FTIV) 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open FTIV 252, while maintaining canister purge valve 261 closed, to depressurize the fuel tank before allowing enabling fuel to be added therein. As such, FTIV 252 may be kept open during the refueling operation to allow refueling vapors to be stored in the canister. After refueling is completed, the FTIV may be closed. In some examples, there may be circumstances where the canister purge valve may be commanded open during refueling, such that a fluid flow in the intake may be monitored, to indicate a presence or absence of evaporative emissions system degradation.

As another example, the fuel system may be operated in a canister purging mode (e.g., after a given emission control device light-off temperature has been attained and with engine 110 running), wherein controller 212 may open canister purge valve 261 and canister vent valve 229 while closing FTIV 252. Herein, the vacuum generated by engine intake manifold 244 of (operating) engine 110 may be used to draw fresh air through vent line 227 and through fuel vapor canister 222 to purge stored fuel vapors into engine intake manifold 244. As such, in the canister purging mode, the purged fuel vapors from fuel vapor canister 222 may be combusted in engine 110. The canister purging mode may be continued until an amount or level of stored fuel vapors in fuel vapor canister 222 are below a threshold amount or level.

Over time and use, the fuel vapor canister 222 may be degraded or damaged and may need to be replaced. However, replacing such canisters may be considerably expensive. Therefore, in certain situations, after removing a faulted canister, instead of replacing the faulted canister with a working canister, to save parts costs, the EVAP system may be tampered with or altered (e.g. by a vehicle operator or vehicle technician) in such a way that there are no detectable leaks in the system. As an example, the canister may be replaced with a straight passage (connecting the fuel vapor line directly to atmosphere), which would allow fuel vapors to escape to the atmosphere during refueling when the FTIV 252 is opened. If a canister is replaced by a straight passage, a leak is not generated in the EVAP system, and therefore is not detectable via a diagnostic test such as an engine off natural vacuum test. Passing the engine off natural vacuum test may include, during an engine-off condition, the fuel tank pressure reaching either a first, higher pressure threshold during a pressure rise test or a second, lower pressure threshold during a vacuum test.

Once it is confirmed that there are no leaks in the EVAP system, presence or absence of the fuel vapor canister 222 may be detected during a refueling. During refueling, a time lag between an increase in fuel level (FLI) and an output of the HC sensor may be monitored. If the time lag between fuel level increase and HC sensor response is lower than a first threshold time, it may be inferred that the fuel vapor canister is missing from the EVAP system. Since it has been confirmed that there are no leaks in the EVAP system, in this case, the detection of the absence of the fuel vapor canister includes detection of the fuel vapor canister being replaced by a straight tube joining a purge line of the EVAP system to a vent line of the EVAP system, i.e., the EVAP system has been altered. If the time lag between fuel level increase and HC sensor response is higher than the first threshold time but lower than a second threshold time, it may be inferred that the fuel vapor canister is present but likely degraded. The second threshold time may be greater than the first threshold time in accordance with the present disclosure. The presence of a degraded fuel vapor canister may further be confirmed using a canister breakthrough test. Furthermore, if the HC sensor never responds during refueling of the fuel tank, the fuel vapor canister may be indicated to be functional.

Control system 190, including controller 212, is shown receiving information from a plurality of sensors 216 (various examples of which are described herein) and sending control signals to a plurality of actuators 281 (various examples of which are described herein). As one example, sensors 216 may include one or more of exhaust gas sensor 237 located upstream of emission control device 270 in exhaust passage 235, temperature sensor 233 located downstream of emission control device 270 in exhaust passage 235, flow meter sensor 220 located in fuel filler pipe 211, fuel level sensor 234 located in fuel tank 144, temperature sensor 232 located in fuel vapor canister 222, and hydrocarbon sensor 298 located in vent line 227. Other sensors such as pressure, temperature, air/fuel ratio, and composition sensors may be coupled to various locations in vehicle system 206 (for example, a fuel tank pressure sensor may further be included in fuel tank 144). As an additional or alternative example, actuators 281 may include fuel injector 266, throttle 262, FTIV 252, canister purge valve 261, and canister vent valve 229. Controller 212 may receive input data from sensors 216, process the input data, and trigger actuators 281 in response to the processed input data based on instructions or code programmed in non-transitory memory therein, the instructions or code corresponding to one or more control routines. For example, during a vehicle off condition or during a refueling event, control system 190 may be configured to monitor a fuel level of fuel tank 144 and the amount of fuel supplied to the fuel tank.

Turning to FIGS. 3A-3B, schematic diagrams of the evaporative emission control system of FIG. 2 are shown, which has been altered instead of replacing a faulted fuel vapor canister 222. FIG. 3A shows an EVAP system indicating tampering or alteration that causes a large detectable leak, while FIG. 3B shows an EVAP system indicating tampering or alteration that causes an undetectable degradation. FIGS. 3A-3B are described herein collectively. As such, components previously introduced in FIG. 2 are numbered similarly in FIGS. 3A-3B and not reintroduced for brevity.

In FIG. 3A, an example view 300 shows evaporative emission control system 251 and fuel system 140 of the vehicle system 206, where the fuel system 140 is disconnected from the evaporative emission control system 251. In the illustrated example, the altered state of the evaporative emission control system 251 includes a missing fuel vapor canister with the conduit 278, vent line 227 and purge line 228 disconnected. For example, a damaged or degraded fuel vapor canister may simply be disconnected from the fuel tank of the fuel system 140 and may be removed with the connections left open to atmosphere causing a large leak in the EVAP system. In the illustrated example, an arrow 302 shows the altered condition of the evaporative emission control system 251 with the fuel vapor canister removed. As a result, the vehicle's onboard diagnostics or an EVAP leak monitor detects a large leak and sets a malfunction indicator lamp (MIL). An example method for detection of a leak in the EVAP system which may be caused due to the absence of the fuel vapor canister is described in FIG. 4.

In some instances, a straight tube may be installed as a defeat device in the evaporative emission control system of a vehicle in lieu of a fuel vapor canister to prevent leak detection by EVAP leak monitor. In FIG. 3B, an example view 350 shows evaporative emission control system 251 and fuel system 140 of the vehicle system 206, where the fuel system 140 is connected to the evaporative emission control system 251 via a straight tube 352. In the illustrated example, the altered state of the evaporative emission control system 251 includes a missing fuel vapor canister with the conduit 278, vent line 227 and purge line 228 connected via the straight tube 352. The straight tube 352 replaces the damaged or degraded fuel vapor canister. As a result of this alteration or tampering of the evaporative emission control system, the vehicle may false pass an emissions test causing an undetectable leak, as this will not set the malfunction indicator lamp (MIL). However, in such an example vehicle, during refueling, as FTIV 252 is opened, fuel vapors from the vapor recovery line 231 and the fuel tank 144 may be released to the atmosphere via the straight tube 352 and the vent line 227, thereby leading to increased evaporative emission levels. An example method for detection of a missing canister in the EVAP system which is replaced by a straight tube is described in FIG. 5.

In this way, the components described in FIGS. 1-3B enable a vehicle system, comprising: a fuel system including a fuel tank; an evaporative emission control system including a hydrocarbon sensor positioned in a vent line, the vent line of the evaporative emission control system fluidically coupled to the fuel tank upstream of the hydrocarbon sensor; and a controller storing instructions in non-transitory memory that, when executed, cause the controller to: during a refueling event, detect presence or absence of a fuel vapor canister coupled to the vent line by monitoring a time lag between an indication of fuel level increase in the fuel tank and a response of the hydrocarbon sensor; and generate an indication of a degradation in the evaporative emission control system based on the monitored time lag.

Figure 4:
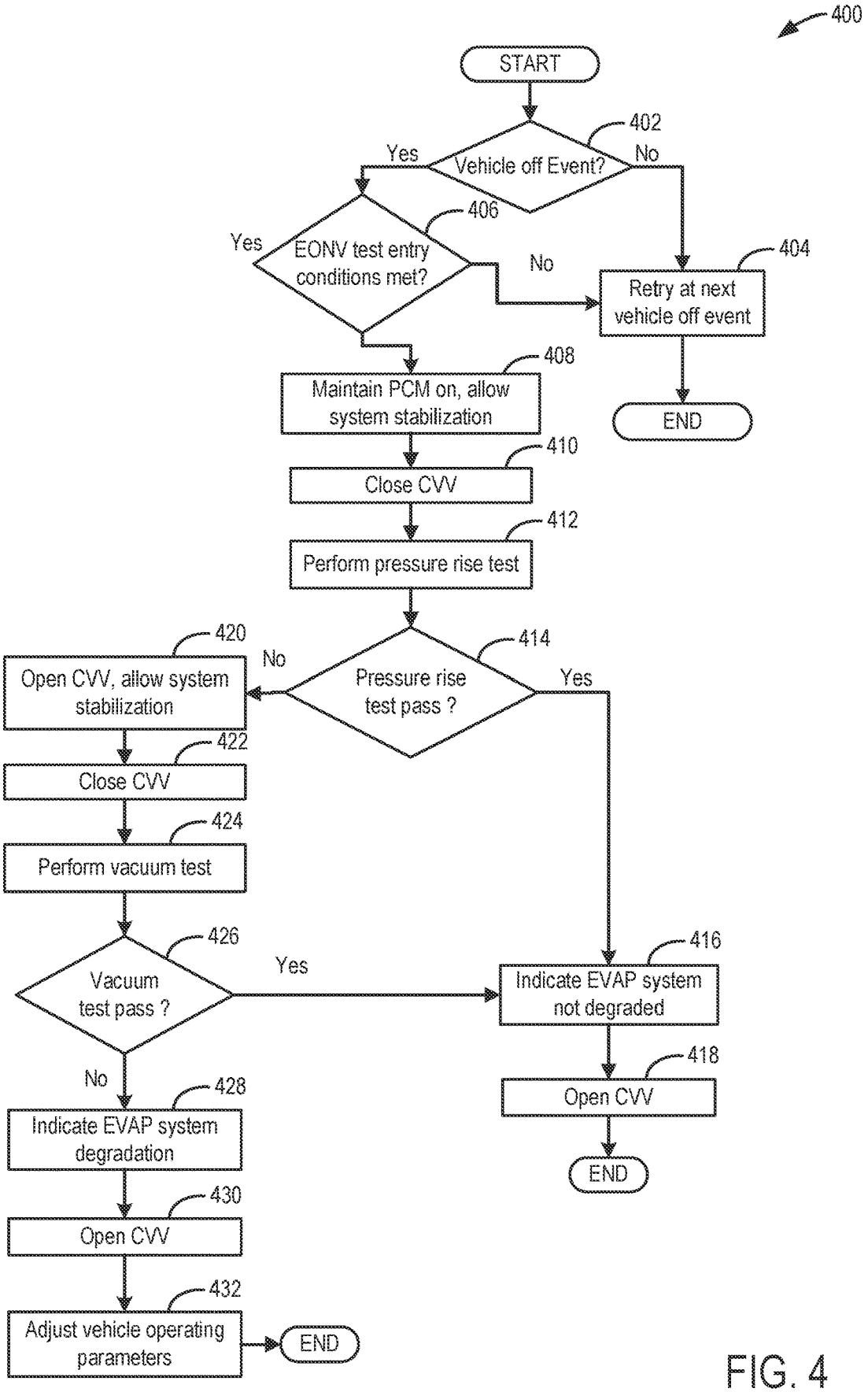
FIG. 4 shows a flow chart of an example method for detecting leaks in the evaporative emission control system of FIG. 2.

Turning to FIG. 4, FIG. 4 shows an example method 400 that may be implemented for detecting leaks in the evaporative emission control system (such as EVAP system 251 in FIG. 2). In one example, the leak may be caused by removal of a defective fuel vapor canister (such as canister 222 in FIG. 2) as shown in FIG. 3A. In this example, an engine-off natural vacuum (EONV) test is shown to detect EVAP system leaks, however, other suitable EVAP system diagnostics test may also be carried out to detect EVAP system leaks such as caused by removal of the canister. Instructions for carrying out method 400 and the rest of the methods included herein may be executed by a controller based on instructions stored on a memory of the controller and in conjunction with signals received from sensors of the engine system, such as the sensors described above with reference to FIGS. 1-3B. The controller may employ engine actuators of the engine system to adjust engine operation, according to the methods described below.

At 402, method 400 includes determining whether a vehicle-off event has occurred. The vehicle-off event may include an engine-off event, and may be indicated by other events, such as a key-off event. The vehicle off event may be indicated by suspension of engine operation followed by the key-off. If no vehicle-off event is detected, method 400 proceeds to 404. At 404, method 400 includes recording that an EONV test was not executed, and further includes setting a flag to retry the EONV test at the next detected vehicle-off event. Method 400 then ends.

If a vehicle-off event is detected, method 400 proceeds to 406. At 406, method 400 includes determining whether entry conditions for an EONV test are met. For an engine-off natural vacuum test, the engine needs to be at rest with all cylinders off, as opposed to engine operation with the engine rotating, even if one or more cylinders are deactivated. Further entry conditions may include a threshold amount of time passed since the previous EONV test, a threshold length of engine run time prior to the engine-off event, a threshold amount of fuel in the fuel tank, and a threshold battery state of charge. The threshold length of engine run time may be based on pre-calibrated duration of engine operation for engine heating. If the engine is operated for a duration shorter than the threshold length of engine run time, the engine may not be sufficiently warm at the vehicle off event for EONV test to be successful. If entry conditions are not met, method 300 proceeds to 404 where the flag may be set to retry the EONV test at the next detected vehicle-off event. Method 400 then ends.

Although entry conditions may be met at the initiation of method 400, conditions may change during the execution of the method. For example, an engine restart or refueling event may be sufficient to abort the method at any point prior to completing method 400. If such events are detected that would interfere with the performing of method 400 or the interpretation of results derived from executing method 400, method 400 may proceed to 404, record that an EONV test was aborted, and set a flag to retry the EONV test at the next detected vehicle-off event, and then end.

If entry conditions are met for carrying out an EONV test, method 400 proceeds to 408. At 408, the PCM may be maintained in an on condition following the vehicle off condition. In this way, the method may continue to be carried out by a controller, such as controller 212, and the EONV test may be initiated. 408 of method 400 further includes allowing the fuel system to stabilize following the vehicle and engine off condition. Allowing the fuel system to stabilize may include waiting for a period of time before method 400 advances. The stabilization period may be a pre-determined amount of time, or may be an amount of time based on current operating conditions. The stabilization period may be based on the predicted ambient conditions. In some examples, the stabilization period may be characterized as the length of time necessary for consecutive measurements of a parameter to be within a threshold of each other. For example, fuel may be returned to the fuel tank from other fuel system components following an engine off condition. The stabilization period may thus end when two or more consecutive fuel level measurements are within a threshold amount of each other, signifying that the fuel level in the fuel tank has reached a steady-state. In some examples, the stabilization period may end when the fuel tank pressure is equal to atmospheric pressure. Following the stabilization period, method 400 then proceeds to 410.

At 410, a canister vent valve (such as CVV 229 in FIG. 2) may be actuated to a closed position. Additionally or alternatively, a fuel tank isolation valve (such as FTIV 252 in FIG. 2) may be actuated to a closed position. In this way, the fuel tank may be isolated from atmosphere. The status of a canister purge valve (such as CPV 261 in FIG. 2) and/or other valves coupled within a conduit connecting the fuel tank to atmosphere may also be assessed and closed if open.

At 412, a pressure rise test may be performed. While the engine is still cooling down post shut-down, there may be additional heat rejected to the fuel tank. With the fuel system sealed via the closing of the CVV, the pressure in the fuel tank may rise due to fuel volatizing with increased temperature. The pressure rise test may include monitoring fuel tank pressure for a period of time. Fuel tank pressure may be monitored until the pressure reaches the adjusted threshold, the adjusted threshold pressure indicative of no leaks above a threshold size in the fuel tank. In some examples, the rate of pressure change may be compared to an expected rate of pressure change. The fuel tank pressure may not reach the threshold pressure. Rather, the fuel tank pressure may be monitored for a predetermined amount of time, or an amount of time based on the current conditions. The fuel tank pressure may be monitored until consecutive measurements are within a threshold amount of each other, or until a pressure measurement is less than the previous pressure measurement. The fuel tank pressure may be monitored until the fuel tank temperature stabilizes.

At 414, method 400 includes determining whether the pressure rise test ended due to a passing result, such as the fuel tank pressure reaching a first pressure threshold. The first pressure threshold may be calibrated based on one or more of fuel level, engine temperature at engine-off, fuel tank capacity, ambient temperature, etc. If the pressure rise test resulted in a passing result, it may be inferred that there are no leaks in the EVAP system. At 416, method 400 includes indicating the passing test result that the EVAP system is not degraded. Indicating the passing result may include recording the successful outcome of the leak test at the controller. It may be confirmed that the fuel vapor canister is in place and has not been removed causing a leak in the EVAP system. At 418, upon completion of the EONV test, the CVV may be actuated to an open position. In this way, the fuel system pressure may be returned to atmospheric pressure. The evaporative emissions leak test schedule may be updated. For example, scheduled leak tests may be delayed or adjusted based on the passing test result. Method 400 then ends.

If a passing result is not indicated based on the first pressure threshold, method 400 proceeds to 420. At 420, the CVV may be opened and the system may be allowed to stabilize. Opening the CVV allows the fuel system pressure to equilibrate to atmospheric pressure. The system may be allowed to stabilize until the fuel tank pressure reaches atmospheric pressure, and/or until consecutive pressure readings are within a threshold of each other. Method 400 then proceeds to 422.

At 422, the CVV may be actuated to a closed position. In this way, the fuel tank may be isolated from atmosphere. As the fuel tank cools, the fuel vapors should condense into liquid fuel, generating a vacuum within the sealed tank. At 424, a vacuum test may be performed. Performing a vacuum test may include monitoring fuel tank pressure for a duration. Fuel tank pressure may be monitored until the vacuum reaches the adjusted threshold, the adjusted threshold vacuum indicative of no leaks above a threshold size in the fuel tank. In some examples, the rate of pressure change may be compared to an expected rate of pressure change. The fuel tank pressure may not reach the threshold vacuum. Rather, the fuel tank pressure may be monitored for a predetermined duration, or a duration based on the current conditions.

At 426, method 400 includes determining whether a passing result was indicated for the vacuum test based on the fuel tank pressure reaching a second pressure threshold. The second pressure threshold may be calibrated based on one or more of fuel level, engine temperature at engine-off, fuel tank capacity, ambient temperature, etc. If a passing result is indicated, it may be inferred that there are no leaks in the EVAP system and the method may proceed to 416. At 416, method 400 includes indicating the passing test result that the EVAP system is not degraded. The method may then end.

Returning to 426, if the vacuum test did not result in a passing result (and also the pressure rise test did not pass), it may be inferred that there is a leak in the EVAP system. At 428, method 400 includes recording the failing test result. Indicating fuel tank degradation may include setting a flag at the controller and activating an MIL to indicate the vehicle operator of the presence of EVAP system degradation. Indicating the failing result may include recording the unsuccessful outcome of the leak test at the controller. The leak may be due to the fuel vapor canister being removed and not replaced by a working canister (or a straight tube). At 430, upon completion of the EONV test, the CVV may be actuated to the open position. In this way, the fuel system pressure may be equilibrated to atmospheric pressure.

In response to the detection of degradation, one or more engine operating parameters. Adjusting engine operating parameters may include adjusting a maximum engine load to reduce fuel consumption, adjusting a commanded A/F ratio, increasing vehicle operation in battery-only mode. Method 400 may then end.

Figure 5:
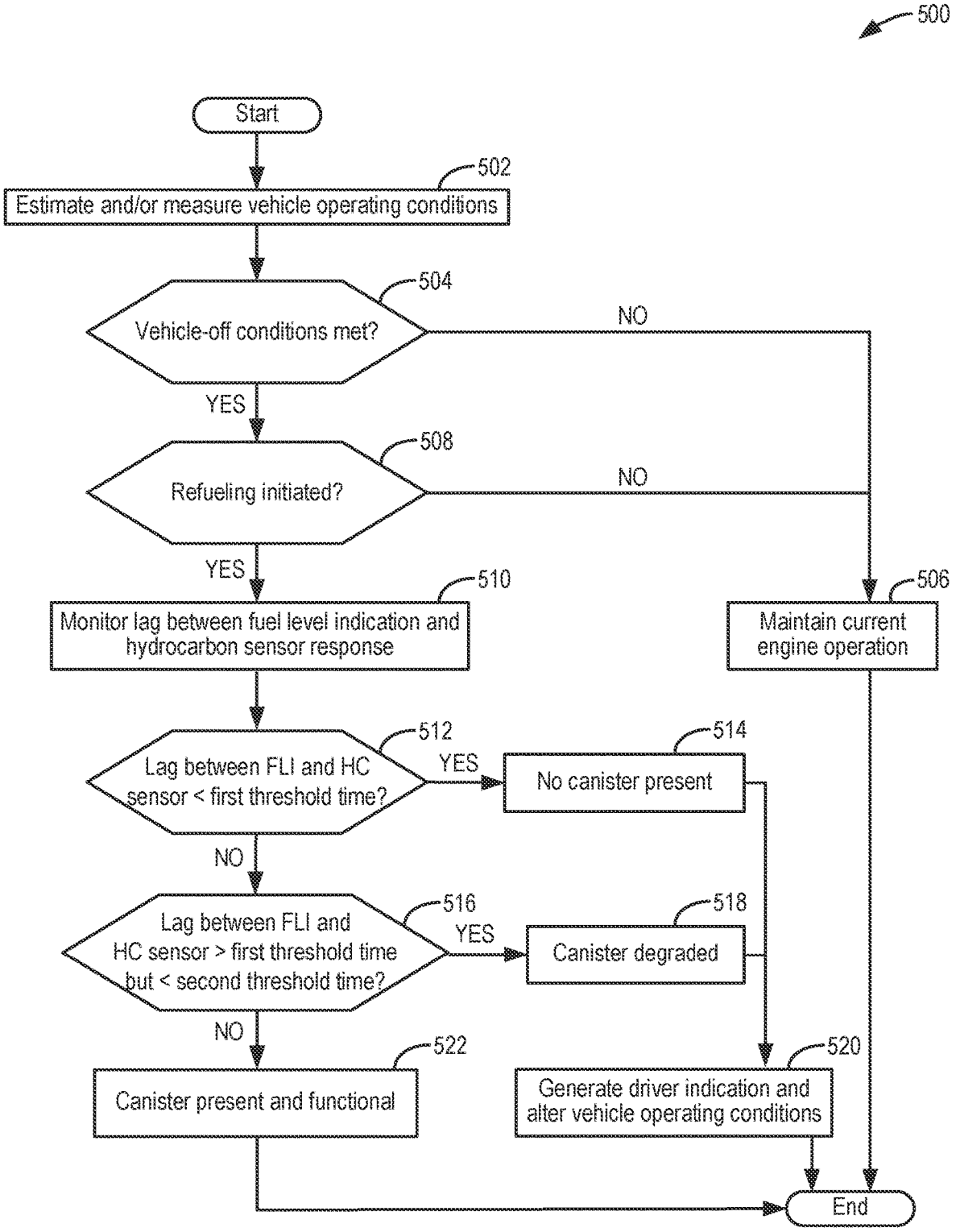
FIG. 5 shows a high-level flow chart of an example method for diagnosing alteration or degradation in the evaporative emission control system of FIG. 2.
Figure 6:
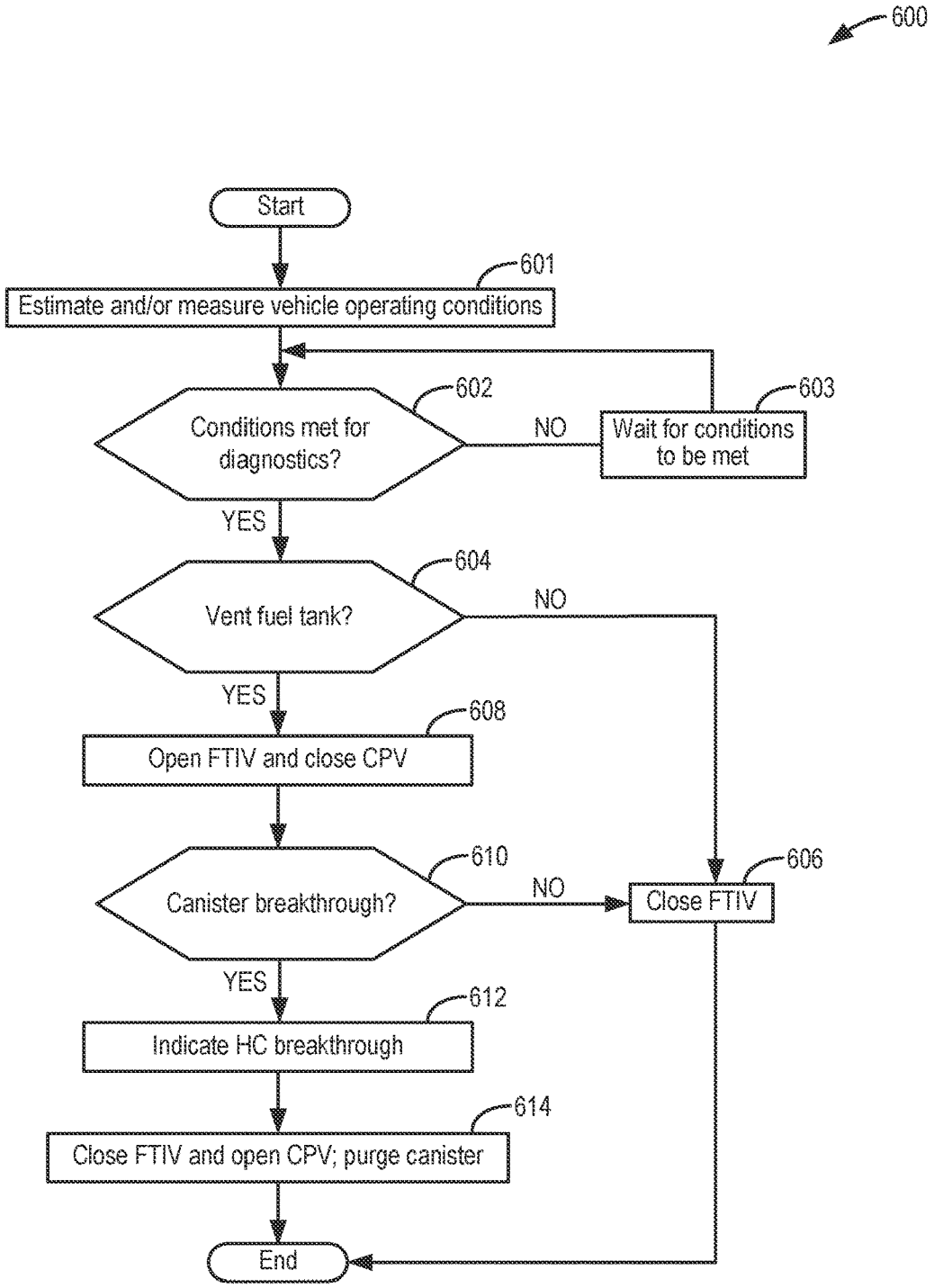
FIG. 6 shows a high-level flow chart of an example method for diagnosing a canister breakthrough in the evaporative emission control system of FIG. 2.

Turning now to FIG. 5, a flow chart of an example method 500 for diagnosing degradation or tampering of an evaporative emission control system of a vehicle is shown. For example, method 500 may be implemented for detecting tampering or degradation in the evaporative emission control system 251 of the vehicle system 206 of FIG. 2. In one example, the tampering may include removal of a defective fuel vapor canister (such as canister 222 in FIG. 2) and replacement of the canister with a straight tube as shown in FIG. 3B. Since the canister is replaced with a straight tube, there is no leak in the EVAP system and therefore degradation of the EVAP system may not be detectable by the EONV test described in FIG. 4. Method 500 may be carried out upon confirmation that the EVAP system is not degraded based on the diagnostic method 400 of FIG. 4. Method 500 may be carried out to detect replacement of the fuel vapor canister by a straight tube in the EVAP system.

The evaporative emission control system may be coupled to an engine controller operable to execute method 500, such as controller 212. For example, the engine controller (e.g., controller 212) may be operable to receive one or more current vehicle operating conditions to determine whether a vehicle including a fuel system (e.g., 140) and the evaporative emission control system (e.g., 251) is in a vehicle-off condition and thereby ready for refueling. Thereafter, during the refueling (e.g., via refueling system 219), various fueling parameters may be monitored (e.g., based on feedback from sensors 216) and a hydrocarbon sensor (e.g., 298) may be monitored to determine a degradation in the evaporative emission control system. For example, by monitoring a time lag between a fuel level increase indication and a HC sensor response, during a refueling event, may determine a tampered or degraded evaporative emission control system. Responsive to a positive determination of the alteration or degradation in the evaporative emission control system, a vehicle operator (e.g., 102) may be notified and one or more engine operating parameters may be altered or adjusted (e.g., via actuation of actuators 281). In this way, the fuel system and the evaporative emission control system may be monitored and subsequently diagnosed, such that vehicle performance may be maintained or improved (e.g., by expedient notification), vehicle operator experience may be enhanced, and overall manufacturing costs may be reduced (e.g., additional or specialized components may be minimized). Additionally, in this way, evaporative emissions may be reduced by identifying vehicles with tampered or degraded evaporative emission control system.

Instructions for carrying out method 500 may be executed by the engine controller (e.g., controller 212) based on instructions stored on a non-transitory memory of the engine controller and in conjunction with signals received from various sensors (e.g., 216), other components of the evaporative emission control system (e.g., 251), other components of the fuel system (e.g., 140), other components of the vehicle coupled to the fuel system, and systems external to the vehicle and coupled thereto via a wireless network (e.g., 131). Further, the engine controller may employ various engine actuators (e.g., 281) to adjust engine operation, e.g., responsive to a determination of the evaporative emission control system degradation, according to method 500 as described below. As such, method 500 may enable monitoring of fueling parameters, HC sensor, and a time lag between fuel level indication and HC sensor response during a refueling event, such that the evaporative emission control system (e.g., 251) may be accurately and efficiently diagnosed.

At 502, method 500 may include estimating and/or measuring one or more vehicle operating conditions. In some examples, the one or more vehicle operating conditions may include one or more engine operating parameters, such as an engine speed, an engine load, an engine temperature, an engine coolant temperature, a fuel temperature, a current operator torque demand, a manifold pressure, a manifold air flow, an exhaust gas air-fuel ratio, etc. In additional or alternative examples, the one or more vehicle operating conditions may include one or more ambient air conditions (e.g., of a surrounding environment), such as an ambient air pressure, an ambient air humidity, an ambient air temperature, etc. In some examples, the one or more vehicle operating conditions may be measured by one or more sensors communicatively coupled to the engine controller (e.g., the engine coolant temperature may be measured directly via a coolant temperature sensor) or may be inferred based on available data (e.g., the engine temperature may be estimated from the engine coolant temperature measured via the coolant temperature sensor).

Method 500 may use the one or more vehicle operating conditions to infer a current state of vehicle operation, and determine whether to diagnose the evaporative emission control system (e.g., 251) based at least on one or more of the engine speed, the engine load, and the current operator torque demand. For example, at 504, method 500 may include determining whether one or more vehicle-off conditions are met. In some examples, the one or more vehicle-off conditions may include one or more vehicle operating conditions immediately following receipt of a key-off request. For instance, the one or more vehicle-off conditions may include the engine speed being less than a threshold engine speed, the engine load being less than a threshold engine load, and/or current operator torque demand being less than a threshold operator torque demand. If the one or more vehicle-off conditions are not met (e.g., if the key-off request is not received or the engine speed, the engine load, or the current operator torque demand is greater than or equal to the respective threshold), method 500 may proceed to 506, where method 500 may include maintaining current engine operation. Specifically, combustion of fuel in cylinders (e.g., 230) of the engine (e.g., 110) may commence/continue and the vehicle may operate without interruption. Further, diagnosis of the evaporative emission control system (e.g., 251) may not be attempted again at least until a next vehicle-off event is successfully initiated. However, if the one or more vehicle-off conditions are met (e.g., if the key-off request is received and the engine speed, the engine load, or the current operator torque demand is less than the respective threshold) at 504, method 500 may proceed to 508.

At 508, method 500 may include determining whether a refueling event has initiated. In some examples, the refueling event may be determined to be initiated when a fuel level of the fuel tank (e.g., 144) increases at a higher than threshold rate for a threshold duration. In other examples, the refueling event may be determined to be initiated responsive to a signal received from an external fuel pump via the wireless network (e.g., 131) indicating that the external fuel pump has started dispensing fuel to the vehicle. In other examples, the refueling event may be determined to be initiated responsive to the fuel dispensing device (e.g., 170) being fluidically coupled to the refueling system (e.g., 219) of the vehicle. If it is determined, at 508, that the refueling event has not initiated (e.g., if the fuel level has not increased within the threshold duration), method 500 may proceed to 506, where method 500 may include maintaining current engine operation. Specifically, combustion of fuel in cylinders (e.g., 230) of the engine (e.g., 110) may commence and the vehicle may operate without interruption. Further, diagnosis of the evaporative emission control system (e.g., 251) may not be attempted again at least until a next refueling event is successfully initiated. Alternatively, if it is determined that the refueling event has initiated at 508 (e.g., if the fuel level has increased within the threshold duration), method 500 may proceed to 510.

At 510, method 500 may include monitoring a time lag between an indication of fuel level increase (FLI) of the fuel tank (e.g., 144) and a response from the HC sensor (e.g., 298) coupled to the vent line (e.g., 227). A fuel level sensor (e.g., 234) disposed within the fuel tank may provide an indication of the fuel level increase during refueling. The HC sensor (e.g., 298) installed at the vent line is configured to detect if fuel vapors are escaping to the atmosphere via the vent line during refueling. In one example, performing the diagnostic method 500 for detecting a missing and/or degraded fuel vapor canister may depend on monitoring a lag between FLI increase and HC sensor response. In one example, the lag between FLI increase and HC sensor response may range from a few seconds to minutes. A threshold of the time lag may vary depending on the type, model, or volume of the fuel tank or model of the HC sensor or a length of the conduit connecting the fuel tank with the evaporative emission control system. Furthermore, during refueling, a fuel tank isolation valve (e.g., FTIV 252) may remain opened and a canister purge valve (e.g., CPV 261) may remain closed while monitoring the lag between FLI indication and HC sensor response.

At 512, method 500 may include determining whether the lag between FLI indication and HC sensor response is lower than a first threshold time M. If it is determined at 512 that the lag between FLI indication and HC sensor response is lower than the first threshold time M, method 500 may move on to 514, where method 500 may include determining an absence of a fuel vapor canister in the evaporative emission control system. In this case, the detection of the absence of the fuel vapor canister includes detection of the fuel vapor canister being replaced by a straight tube joining a purge line of the EVAP system to a vent line of the EVAP system. This scenario may occur during an alteration or tampering of the evaporative emission control system, as shown previously with reference to FIG. 3B. A missing fuel vapor canister from the evaporative emission control system of a vehicle and replacement of the canister with a straight tube may allow fuel vapors from refueling of the fuel tank to reach the HC sensor in the vent line almost immediately after the fuel level begins to increase. As a result, the HC sensor detects the presence of hydrocarbons in the fuel vapors, en route to atmosphere via the vent line, and responds before the first threshold time M.

Responsive to a missing fuel vapor canister and a tampered evaporative emission control system, a vehicle operator may be notified and one or more vehicle operating conditions may be altered or adjusted (e.g., via actuation of actuators 281), at 520, so as to reduce HC emissions into the atmosphere. In some examples, a generated driver indication may be displayed to the vehicle operator (e.g., 102) at a vehicle instrument panel (e.g., 196) or other display visible to the vehicle operator. In such examples, the driver indication may indicate an absence of the fuel vapor canister, in addition to instructions for repair or recommendations as to installation of the canister. Additionally or alternatively, the driver indication may include lighting a malfunction indicator lamp (MIL) and a corresponding diagnostic code may be set and stored in the memory of the engine controller. In one example, lighting the MIL may indicate a request that the vehicle be taken to a service technician, and the diagnostic code that is set may indicate to the service technician that the fuel vapor canister is missing. The light and the code may reset after the vehicle has been serviced and the fuel vapor canister has been installed. Additionally, to mitigate an amount of untreated fuel vapors escaping from the fuel tank, one or more of the vehicle operating conditions that generate excess fuel vapors may be altered or adjusted. For instance, one or more of the engine operating parameters may be altered or adjusted (e.g., minimized, maintained below respective thresholds, lowered to near or at zero, etc.), including, for example, one or more of the engine speed and the engine load. Additionally or alternatively, the engine controller (e.g., controller 212) may command the vehicle enter an electric drive mode, where only a motor (e.g., 120) may propel drive wheels (e.g., 130) of the vehicle so that the fueling system (e.g., 140) is not relied upon to power the engine (e.g., 110). The one or more vehicle operating conditions may remain altered or adjusted until servicing of the evaporative emission control system may be performed and installation of the fuel vapor canister may be completed.

Returning to 512, if it is determined that the lag between FLI indication and HC sensor response is not lower than the first threshold time M, i.e., if the HC sensor does not respond prior to the first threshold time M, method 500 may proceed to 516.

At 516, method 500 may include determining whether the lag between FLI indication and HC sensor response is higher than the first threshold time M and lower than a second threshold time N. If it is determined at 516 that the lag between FLI indication and HC sensor response is higher than the first threshold time M and lower than the second threshold time N, method 500 may move on to 518, where method 500 may include determining a presence of a fuel vapor canister which is likely degraded. A degraded fuel vapor canister in the evaporative emission control system of a vehicle may allow fuel vapors to reach the HC sensor in the vent line midway through refueling of the fuel tank. As a result, the HC sensor detects the presence of hydrocarbons in the fuel vapors, en route to atmosphere via the vent line, and responds after the first threshold time M but before the second threshold time N, indicating that the degraded canister was unable to adsorb all of the refueling vapors. This scenario may occur if the loading state of the fuel vapor canister prior to refueling was clean and the fuel vapor canister was not already loaded with hydrocarbons. In order to confirm whether the fuel vapor canister of the evaporative emission control system is degraded or overloaded, a confirmatory diagnostic test shown in FIG. 6 may be utilized.

Responsive to a degraded fuel vapor canister in the evaporative emission control system, a vehicle operator may be notified and one or more vehicle operating conditions may be altered or adjusted (e.g., via actuation of actuators 281), at 520, so as to reduce HC emissions into the atmosphere. In some examples, a generated driver indication may be displayed to the vehicle operator (e.g., 102) at a vehicle instrument panel (e.g., 196) or other display visible to the vehicle operator. In such examples, the driver indication may indicate a presence of the degraded fuel vapor canister, in addition to instructions for repair or recommendations as to maintenance of the degraded component. Additionally or alternatively, the driver indication may include lighting a malfunction indicator lamp (MIL) and a corresponding diagnostic code may be set and stored in the memory of the engine controller. In one example, lighting the MIL may indicate a request that the vehicle be taken to a service technician, and the diagnostic code that is set may indicate to the service technician that the fuel vapor canister is degraded. The light and the code may reset after the vehicle has been serviced and the degraded fuel vapor canister has been replaced or repaired. Additionally, to mitigate an amount of untreated fuel vapors escaping from the fuel tank, one or more of the vehicle operating conditions that generate excess fuel vapors may be altered or adjusted. For instance, one or more of the engine operating parameters may be altered or adjusted (e.g., minimized, maintained below respective thresholds, lowered to near or at zero, etc.), including, for example, one or more of the engine speed and the engine load. Additionally or alternatively, the engine controller (e.g., controller 212) may command the vehicle enter an electric drive mode, where only a motor (e.g., 120) may propel drive wheels (e.g., 130) of the vehicle so that the fueling system (e.g., 140) is not relied upon to power the engine (e.g., 110). The one or more vehicle operating conditions may remain altered or adjusted until servicing of the evaporative emission control system may be performed and the degraded fuel vapor canister may be repaired or replaced.

Returning to 516, if it is determined that the lag between FLI indication and HC sensor response is not lower than the second threshold time N or if the HC sensor in the vent line never responds as the fuel level of the fuel tank increases during refueling, method 500 may proceed to 522, where method 500 may determine presence of a fully functional fuel vapor canister in the evaporative emission control system. Method 500 may then end.

Referring to FIG. 6, an example method 600 is shown for diagnosing leaks in a fuel vapor canister or a degraded canister of a vehicle evaporative emission control system, such as the evaporative emission control system 251 described above with reference to FIG. 2. Instructions for carrying out method 600 may be executed by a controller (e.g., controller 212) based on instructions stored on a memory of the controller and in conjunction with signals received from sensors of the engine system, such as the sensors (e.g., 216) described above with reference to FIG. 2. Further, the controller may employ engine actuators (e.g., 281) of the engine system to adjust engine operation, e.g., responsive to a determination of a canister breakthrough, according to method 600 as described below.

At 601, vehicle operating conditions are estimated by the controller. The controller (e.g., controller 212) acquires measurements from various sensors in the engine system and estimates operating conditions such as engine load, engine speed, engine temperature, and the load of the fuel vapor canister. The load of a canister (e.g., canister 222) is an amount of fuel vapor stored in the canister. In one example, the canister load may be estimated based on a first time elapsed since an immediately previous purge event wherein fuel vapor from the canister was routed to the engine for combustion. The canister load is further estimated based on a duration of opening of the FTIV (e.g., FTIV 252) such as during a refueling event following the immediately previous purge event to allow flow of fuel vapor from the fuel tank to the canister thereby increasing canister load. In another example, during purging, an estimated vapor amount/concentration can be used to determine the amount of fuel vapors stored in the canister, and then during a later portion of the purging operation (when the canister is sufficiently purged or empty), the estimated vapor amount/concentration can be used to estimate a loading state of the fuel vapor canister. In yet another example, canister load may be estimated based on outputs of one or more oxygen sensors coupled to the canister (e.g., downstream of the canister), or positioned in the engine intake and/or engine exhaust, to provide an estimate of a canister load. The controller may further detect states of the valves and measure fuel tank pressure with a pressure sensor.

At 602, the controller determines if conditions are met for canister diagnostics. As an example, the conditions may include the canister load being higher than a threshold load Q (e.g., not empty canister) and lower than a threshold load R (e.g., not at full capacity). If it is determined at 602 that the canister load is lower than the threshold load Q (i.e., canister is empty) or higher than the threshold load R (i.e., canister is in full capacity), the conditions for canister diagnostics are not met and method 600 moves on to 603. At 603, the method waits for conditions to be met. For example, the method may wait for an empty canister to be loaded such that the canister load is higher than the threshold load Q or the method may wait for a fully loaded canister to be purged to the intake manifold such that the canister load is lower than the threshold load R. Method 600 may then return to 602. If it is determined at 602 that the canister load is higher than the threshold load Q (e.g., not empty canister) and lower than the threshold load R (e.g., not at full capacity), the conditions for canister diagnostics are met and method 600 proceeds to 604.

At 604, the controller determines if the fuel tank (e.g., fuel tank 144) needs to be vented. As an example, the controller may determine to vent the fuel tank if the measured fuel tank pressure from 601 is higher than a predetermined non-zero threshold pressure. As another example, the controller may determine to vent the fuel tank during vehicle refueling. If the controller determines not to vent the fuel tank, method 600 moves on to 606, wherein the fuel tank may be isolated from the evaporative emissions control system by closing the FTIV (e.g., FTIV 252). Otherwise, method 600 proceeds to 608, wherein the controller opens FTIV (e.g., FTIV 252) and closes canister purge valve (e.g., 261) so that the fuel vapor canister enters the loading mode. Additionally, a canister vent valve (e.g., 229) and/or an ELCM changeover valve located in the vent line are adjusted to an opened position, thereby coupling the canister to atmosphere. During the loading mode, fuel vapors from the fuel tank are vented through the canister to atmosphere. HCs in the fuel vapors are adsorbed and stored in the canister.

At 610, the controller determines if there is a canister breakthrough. The HC sensor (e.g., HC sensor 298) coupled to the vent line (e.g., vent line 227) between the canister and the atmosphere monitors HC content in the vented fuel vapors to the atmosphere. If the HC content is lower than a threshold amount, it may indicate that there are no leaks in the canister and method 600 moves on to 606, wherein the fuel tank may be isolated from the evaporative emissions control system by closing the FTIV. If the HC content in the vented fuel vapors is higher than a threshold amount, canister leak may be determined and method 600 proceeds to 612 to indicate HC breakthrough from the canister and set a corresponding diagnostic code. Responsive to a positive determination of the leak, a vehicle operator may be notified and one or more engine operating parameters may be altered or adjusted (e.g., via actuation of actuators 281). The controller may close FTIV and open canister purge valve to purge the fuel vapor canister at 614. The controller may further increase the duration and frequency of canister purging at 614, in response to the leak. Additionally, the canister vent valve and/or the ELCM changeover valve located in the vent line may be adjusted to a closed position, thereby isolating the canister from the atmosphere. Furthermore, the controller may store the time that the diagnostic test for the fuel vapor canister is performed in the memory for future reference.

The method 600 (described above in FIG. 6) for diagnosing a degraded fuel vapor canister may be performed as a confirmatory test after performing the example method of FIG. 5 for detecting altered or degraded evaporative emission control system. This ensures that the hydrocarbons in the vent line of the evaporative emission control system is coming only from a degraded canister and not from a fully loaded canister. This also allows the use of a single hydrocarbon sensor for multiple purposes.

Figure 7:
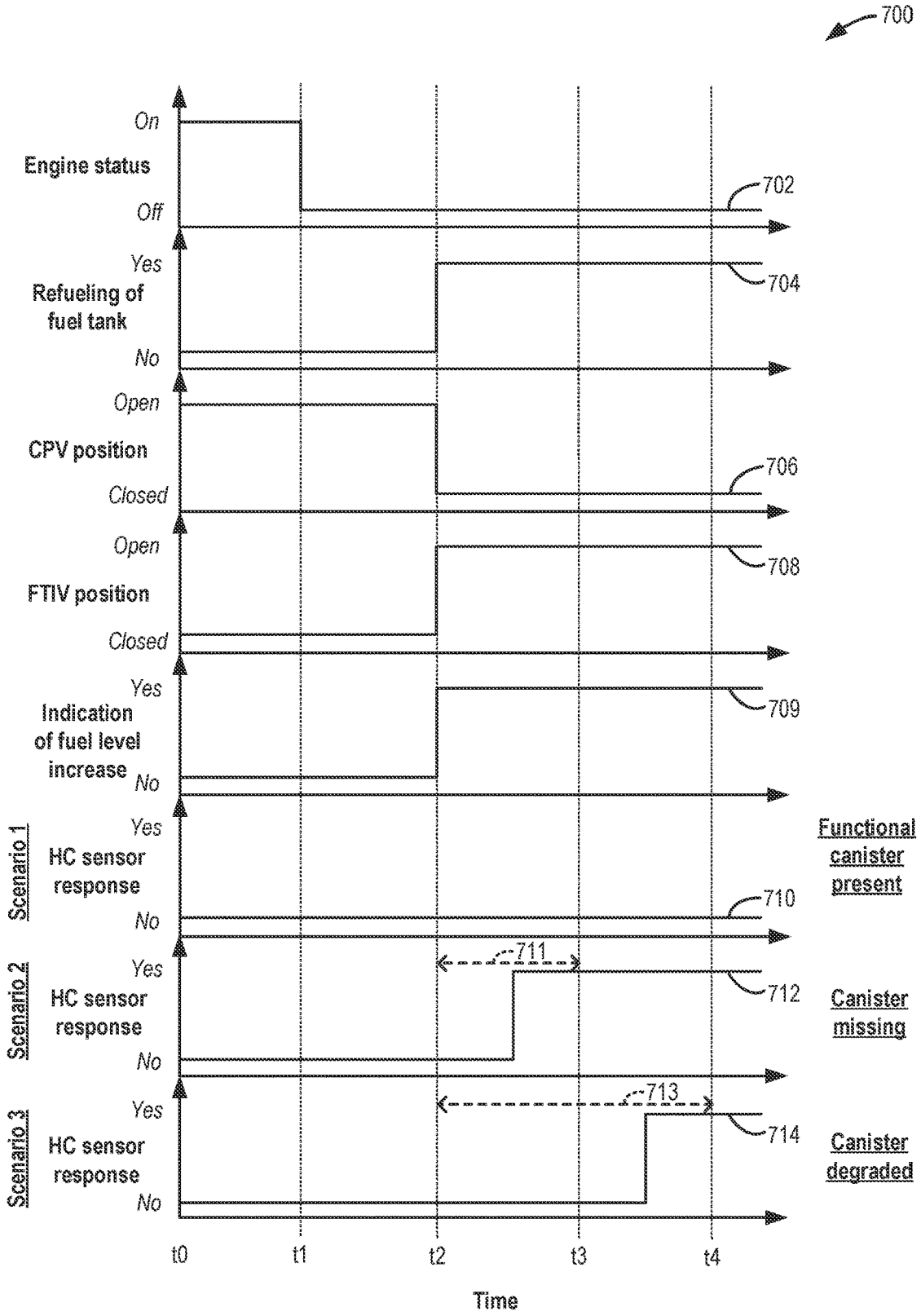
FIG. 7 shows an example timeline for a diagnostics routine of an evaporative emission control system of a vehicle.

Referring now to FIG. 7, a timing diagram 700 is shown that illustrates a sequence of actions performed within a diagnostic procedure for diagnosing a missing, altered or degraded fuel vapor canister in an evaporative emission control system of a HEV vehicle system. The diagnostic procedure may be the same as or similar to steps 502-522 of method 500 described above with reference to FIG. 5. Instructions for performing the actions described in the timing diagram 700 of FIG. 7 may be executed by a controller (e.g., the controller 212 of control system 190 of FIG. 2) based on instructions stored on a memory of the controller and in conjunction with signals received from sensors of the vehicle system, such as the sensors 216 of the vehicle system 206 described above with reference to FIGS. 1 and 2.

Timing diagram 700 shows plots 702, 704, 706, 708, 709, 710, 712, and 714, which illustrate states of components of the vehicle system over time. Plot 702 indicates a state of an engine of the vehicle system (e.g., the engine 110 of the vehicle system 206 of FIG. 2), which may be in an ON state or an OFF state. Plot 704 indicates refueling of a fuel tank (e.g., the fuel tank 144 of FIG. 4A), where YES indicates that the fuel tank is being refueled and NO indicates that the fuel tank is not being refueled. Plot 706 indicates a state of a canister purge valve (e.g., CPV 261 of FIG. 2), which may be in an OPEN position or a CLOSED position. Plot 708 indicates a state of a fuel tank isolation valve (e.g., FTIV 252 of the vehicle system 206 of FIG. 2), which may be in an OPEN position or a CLOSED position. Plot 709 indicates fuel level increase in the fuel tank, where YES indicates that the fuel level is increasing and NO indicates that the fuel level is not increasing. Plots 710, 712 and 714 show response of a hydrocarbon sensor over time (e.g., the HC sensor 298 of the vehicle system 206 of FIG. 2) corresponding to a presence or absence of fuel vapors in a vent line of an evaporative emission control system (e.g., the evaporative emission control system 251 of FIG. 2), where plot 710 shows HC sensor response under a first scenario (e.g., presence of a functional fuel vapor canister), plot 712 shows HC sensor response under a second scenario (e.g., absence of a fuel vapor canister), and plot 714 shows HC sensor response under a third scenario (e.g., presence of a degraded fuel vapor canister). Dotted lines 711 and 713 represent a first threshold time and a second threshold time, respectively, where the first threshold time and the second threshold time may be defined as lengths of time or time lag between an indication of fuel level increase and a response of HC sensor.

Plots 702, 704, 706, 708, 709, 710, 712, and 714 illustrate states of the above mentioned components of the vehicle system across four durations: a first duration from time t0 to time t1; a second duration from time t1 to time t2; a third duration from time t2 to time t3; and a fourth duration from time t3 to time t4.

At time t0 and over the first duration from time t0 to time t1, the vehicle engine is in an ON state at plot 702. No refueling of the fuel tank is ongoing at plot 704, and thus, no fuel level increase in fuel tank is indicated at plot 709 at time to. Accordingly, canister purge valve is in an open position at plot 706, and fuel tank isolation valve is in a closed position at plot 708. In one example, the vehicle is being driven with engine ON at time t0. Since the conditions for the diagnostic test of the evaporative emission control system are not met at time t0, the method waits for a vehicle-off condition to be met.

At time t1, the vehicle engine is turned off at plot 702. Over the second duration from time t1 to time t2, the vehicle engine remains in an OFF state at plot 702. In one example, due to a decrease in torque demand, the vehicle-off condition may be met during this period. Additionally, over the second duration from time t1 to time t2, plots 704, 706, 708, 709, 710, 712, and 714 remain unchanged.

At time t2, with the vehicle engine OFF, refueling of the fuel tank is initiated at plot 704. Accordingly, fuel level increase in the fuel tank is indicated at plot 709. The canister purge valve is adjusted to a closed position at plot 706, and the fuel tank isolation valve is adjusted to an open position at plot 708 at time t2. Additionally, over the third and fourth durations from time t2 to time t3 and from time t3 to time t4, plots 702, 704, 706, 708, and 709 remain unchanged.

To determine whether a degradation condition exists in the evaporative emission control system of the vehicle, a length of time after which the hydrocarbon sensor responds, during refueling, is monitored. As described previously with reference to FIG. 5, during a refueling event, a time lag between an indication of fuel level increase (FLI) in fuel tank and a response of a HC sensor corresponding to detection of fuel vapors may be utilized to determine whether a fuel vapor canister is present or absent in a vehicle system. The dotted line 711, over the third duration from time t2 to time t3, represents the first threshold time; and the dotted line 713, over the third and fourth durations from time t2 to time t4, represents the second threshold time.

As shown in plot 712, HC sensor responds within the third duration from time t2 to time t3, i.e., within the first threshold time (dotted line 711). This indicates that the time lag between FLI indication and HC sensor response is lower than the first threshold time 711, whereby it is concluded that the fuel vapor canister may be missing from the evaporative emission control system of the vehicle under scenario 2. In one example, the fuel vapor canister may be replaced with a straight tube, as shown with reference to FIGS. 3A-3B, such that the fuel vapors from refueling may reach the HC sensor quickly via the straight tube.

Alternatively, plot 714 shows HC sensor response within the fourth duration from time t3 to time t4, i.e., after the first threshold time (dotted line 711) but within the second threshold time (dotted line 713). This indicates that the time lag between FLI indication and HC sensor response is higher than the first threshold time 711 but lower than the second threshold time 713, whereby it is concluded that a degraded fuel vapor canister may be present in the evaporative emission control system of the vehicle under scenario 3. In one example, the degraded fuel vapor canister may be unable to adsorb all of the refueling vapors, due to which the fuel vapors may reach the HC sensor midway through refueling.

In a yet alternative scenario, plot 710 shows no HC sensor response at all, indicating that fuel vapors or hydrocarbon content is not detected during refueling, whereby it is concluded that fuel vapor canister is present and functional and no degradations or alterations exist in the evaporative emission control system of the vehicle under scenario 1.

In this way, a degradation and/or alteration in an evaporative emission control system of a vehicle may be diagnosed. The systems and the diagnostic methods, according to the present disclosure, assist in identifying vehicles with tampered or degraded evaporative emission control system rapidly and efficiently. The methods in accordance with the present disclosure are not only useful for monitoring vehicle emissions for vehicle certification but also for reducing undesired hydrocarbon emissions and comply with regulations. Furthermore, overall manufacturing costs are reduced as installation of additional or specialized components may be minimized.

The disclosure also provides support for a method for a vehicle, comprising: during a refueling event, detecting presence or absence of a fuel vapor canister coupled to a vent line of an evaporative emission control system of the vehicle based on a response of a hydrocarbon sensor coupled to the vent line. In a first example of the method, the detection of the presence or the absence of the fuel vapor canister is carried out upon passing of an engine off natural vacuum test indicating absence of a leak in the evaporative emission control system. In a second example of the method, optionally including the first example, the hydrocarbon sensor detects fuel vapors escaping through the vent line during the refueling event. In a third example of the method, optionally including one or both of the first and second examples, detecting the presence or absence of the fuel vapor canister includes monitoring a time lag between an indication of a fuel tank fuel level increase and the response of the hydrocarbon sensor. In a fourth example of the method, optionally including one or more or each of the first through third examples, the method further comprises: generating an indication of a degradation in the evaporative emission control system of the vehicle based on the monitored time lag. In a fifth example of the method, optionally including one or more or each of the first through fourth examples, the absence of the fuel vapor canister is indicated in response to the monitored time lag being lower than a first threshold time, and wherein the indication of the absence of the fuel vapor canister includes detection of the fuel vapor canister being replaced by a straight tube joining a purge line to the vent line of the evaporative emission control system. In a sixth example of the method, optionally including one or more or each of the first through fifth examples, a degradation of the fuel vapor canister is indicated in response to the monitored time lag being higher than the first threshold time and lower than a second threshold time. In a seventh example of the method, optionally including one or more or each of the first through sixth examples, no degradation of the fuel vapor canister is indicated in response to the monitored time lag being higher than the second threshold time. In an eighth example of the method, optionally including one or more or each of the first through seventh examples, the fuel tank fuel level increase is measured via a fuel level sensor disposed within the fuel tank. In a ninth example of the method, optionally including one or more or each of the first through eighth examples, the method further comprises: after generating the indication of the degradation, altering one or more vehicle operating conditions to reduce emissions during a vehicle on condition, wherein altering the one or more vehicle operating conditions comprises one or more of: altering one or more of an engine speed and an engine load, and entering an electric drive mode of the vehicle.

The disclosure also provides support for a diagnostic method for a vehicle, comprising: with the vehicle turned off during a refueling event, detecting presence or absence of a fuel vapor canister coupled to a vent line of an evaporative emission control system of the vehicle by monitoring a time lag between an indication of a fuel tank fuel level increase and a response of a hydrocarbon sensor coupled to the vent line, and generating an indication of a degradation or alteration in the evaporative emission control system of the vehicle based on the monitored time lag. In a first example of the method, the hydrocarbon sensor detects fuel vapors escaping through the vent line during the refueling event. In a second example of the method, optionally including the first example, an absence of the fuel vapor canister is indicated in response to the monitored time lag being lower than a first threshold time, and wherein the indication of the absence of the fuel vapor canister includes detection of the fuel vapor canister being replaced by a straight tube joining a purge line to the vent line of the evaporative emission control system. In a third example of the method, optionally including one or both of the first and second examples, a degradation of the fuel vapor canister is indicated in response to the monitored time lag being each of a higher than the first threshold time and a lower than a second threshold time. In a fourth example of the method, optionally including one or more or each of the first through third examples, no degradation of the fuel vapor canister is indicated in response to the monitored time lag being higher than the second threshold time. In a fifth example of the method, optionally including one or more or each of the first through fourth examples, the method further comprises: after generating the indication of the degradation, altering one or more vehicle operating conditions to reduce emissions during a vehicle on condition, wherein altering the one or more vehicle operating conditions comprises one or more of: altering one or more of an engine speed and an engine load, and entering an electric drive mode of the vehicle.

The disclosure also provides support for a vehicle system, comprising: a fuel system including a fuel tank, an evaporative emission control system including a hydrocarbon sensor positioned in a vent line, the vent line of the evaporative emission control system fluidically coupled to the fuel tank upstream of the hydrocarbon sensor, and a controller storing instructions in non-transitory memory that, when executed, cause the controller to: during a refueling event, detect presence or absence of a fuel vapor canister coupled to the vent line by monitoring a time lag between an indication of fuel level increase in the fuel tank and a response of the hydrocarbon sensor, and generate an indication of a degradation in the evaporative emission control system based on the monitored time lag. In a first example of the system, the controller stores further instructions to indicate an absence of the fuel vapor canister in response to the monitored time lag being lower than a first threshold time. In a second example of the system, optionally including the first example, the indication of the degradation in the evaporative emission control system is generated by displaying a notification to an operator of the vehicle during a vehicle on condition. In a third example of the system, optionally including one or both of the first and second examples, the vehicle is a hybrid electric vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

during a refueling event, detecting presence or absence of a fuel vapor canister coupled to a vent line of an evaporative emission control system of the vehicle based on a response of a hydrocarbon sensor coupled to the vent line, and wherein detecting the presence or absence of the fuel vapor canister includes monitoring a time lag between an indication of a fuel tank fuel level increase and the response of the hydrocarbon sensor.

2. The method of claim 1, wherein the detection of the presence or the absence of the fuel vapor canister is carried out upon passing of an engine off natural vacuum test indicating absence of a leak in the evaporative emission control system.

3. The method of claim 1, wherein the hydrocarbon sensor detects fuel vapors escaping through the vent line during the refueling event.

4. The method of claim 1, further comprising generating an indication of a degradation in the evaporative emission control system of the vehicle based on the monitored time lag.

5. The method of claim 4, wherein the absence of the fuel vapor canister is indicated in response to the monitored time lag being lower than a first threshold time, and wherein the indication of the absence of the fuel vapor canister includes detection of the fuel vapor canister being replaced by a straight tube joining a purge line to the vent line of the evaporative emission control system.

6. The method of claim 5, wherein a degradation of the fuel vapor canister is indicated in response to the monitored time lag being higher than the first threshold time and lower than a second threshold time.

7. The method of claim 6, wherein no degradation of the fuel vapor canister is indicated in response to the monitored time lag being higher than the second threshold time.

8. The method of claim 1, wherein the fuel tank fuel level increase is measured via a fuel level sensor disposed within the fuel tank.

9. The method of claim 4, further comprising, after generating the indication of the degradation, altering one or more vehicle operating conditions to reduce emissions during a vehicle on condition, wherein altering the one or more vehicle operating conditions comprises one or more of:

altering one or more of an engine speed and an engine load; and entering an electric drive mode of the vehicle.

10. A diagnostic method for a vehicle, comprising:

with the vehicle turned off during a refueling event, detecting presence or absence of a fuel vapor canister coupled to a vent line of an evaporative emission control system of the vehicle by monitoring a time lag between an indication of a fuel tank fuel level increase and a response of a hydrocarbon sensor coupled to the vent line; and generating an indication of a degradation or alteration in the evaporative emission control system of the vehicle based on the monitored time lag.

11. The diagnostic method of claim 10, wherein the hydrocarbon sensor detects fuel vapors escaping through the vent line during the refueling event.

12. The diagnostic method of claim 10, wherein an absence of the fuel vapor canister is indicated in response to the monitored time lag being lower than a first threshold time, and wherein the indication of the absence of the fuel vapor canister includes detection of the fuel vapor canister being replaced by a straight tube joining a purge line to the vent line of the evaporative emission control system.

13. The diagnostic method of claim 12, wherein a degradation of the fuel vapor canister is indicated in response to the monitored time lag being each of a higher than the first threshold time and a lower than a second threshold time.

14. The diagnostic method of claim 13, wherein no degradation of the fuel vapor canister is indicated in response to the monitored time lag being higher than the second threshold time.

15. The diagnostic method of claim 10, further comprising, after generating the indication of the degradation, altering one or more vehicle operating conditions to reduce emissions during a vehicle on condition, wherein altering the one or more vehicle operating conditions comprises one or more of:

altering one or more of an engine speed and an engine load; and entering an electric drive mode of the vehicle.

16. A vehicle system, comprising:

a fuel system including a fuel tank;

an evaporative emission control system including a hydrocarbon sensor positioned in a vent line, the vent line of the evaporative emission control system fluidically coupled to the fuel tank upstream of the hydrocarbon sensor; and a controller storing instructions in non-transitory memory that, when executed, cause the controller to:

during a refueling event, detect presence or absence of a fuel vapor canister coupled to the vent line by monitoring a time lag between an indication of fuel level increase in the fuel tank and a response of the hydrocarbon sensor; and generate an indication of a degradation in the evaporative emission control system based on the monitored time lag.

17. The vehicle system of claim 16, wherein the controller stores further instructions to indicate an absence of the fuel vapor canister in response to the monitored time lag being lower than a first threshold time.

18. The vehicle system of claim 16, wherein the indication of the degradation in the evaporative emission control system is generated by displaying a notification to an operator of the vehicle during a vehicle on condition.

19. The vehicle system of claim 16, wherein the vehicle is a hybrid electric vehicle.

* * * * *